US009768523B1

(12) United States Patent
Zukowski

(10) Patent No.: US 9,768,523 B1
(45) Date of Patent: Sep. 19, 2017

(54) IN-LINE TWIST ON ELECTRICAL WIRE CONNECTOR

(71) Applicant: Stanislaw L Zukowski, Flagstaff, AZ (US)

(72) Inventor: Stanislaw L Zukowski, Flagstaff, AZ (US)

( * ) Notice: Subject to any disclaimer, the term of this patent is extended or adjusted under 35 U.S.C. 154(b) by 0 days.

(21) Appl. No.: 15/397,784

(22) Filed: Jan. 4, 2017

(51) Int. Cl.
*H01R 4/12* (2006.01)

(52) U.S. Cl.
CPC ..... *H01R 4/12* (2013.01)

(58) Field of Classification Search
CPC ..... H01R 4/22; H01R 4/12
USPC ..... 174/91, 87, 94 R, 94 S, 93, 90, 84 S
See application file for complete search history.

(56) References Cited

U.S. PATENT DOCUMENTS 1,657,253 A * 1/1928 Fortin ..... H01R 13/33 174/153 R
1,657,933 A * 1/1928 Lindsley ..... H01R 4/12 174/84 S
1,763,298 A * 6/1930 Franzen ..... H01R 4/12 174/94 R
1,854,782 A 4/1932 Cook
1,854,783 A 4/1932 Cook
2,063,718 A 12/1936 Berndt
2,078,051 A 4/1937 Berndt
2,120,469 A 6/1938 Kyle
2,128,832 A 8/1938 Lusher
2,144,050 A 1/1939 Fotsch
2,166,458 A 7/1939 Nycum et al.
2,359,541 A * 10/1944 Bancroft ..... H01R 4/2412 439/417
2,434,358 A * 1/1948 Frank ..... B21F 15/06 174/84 S
2,470,423 A * 5/1949 Alford ..... H01R 4/2412 174/84 S
2,521,722 A * 9/1950 Hubbell ..... H01R 13/33 439/732
2,572,940 A 10/1951 Lockhart
2,725,545 A * 11/1955 Gordon ..... H01R 4/2412 174/91

(Continued)

FOREIGN PATENT DOCUMENTS

CA 1294681 1/1992
CA 1301876 5/1992

(Continued)

*Primary Examiner* — Ross Gushi
(74) *Attorney, Agent, or Firm* — Invention To Patent Services; Alex Hobson

(57) ABSTRACT

An in-line wire connector has a connector body with two insert ends on opposing ends for receiving a first and a second wire into apertures. A truncated tapered coil is configured within the connector body to secure the first and second wires to the in-line wire connector. The in-line twist on wire connector connects wires in line and may be low profile to allow the wires and the wire connector to slide through apertures and tight spaces as it often required in construction and remodeling projects. An in-line wire connector may have two truncated tapered coils that taper toward the opposing ends. A first and second wire conductor extend past each other toward opposing insert ends to produce an overlap portion to create electrical contact between wires. When the connector body is rotated, the wires rotate about each other and are retained by the tapered coil.

12 Claims, 6 Drawing Sheets

(56) References Cited

U.S. PATENT DOCUMENTS 2,792,560 A 5/1957 Bollmeier
2,859,424 A 11/1958 Verndt
2,885,771 A 5/1959 Schinske
2,999,223 A * 9/1961 Peter ..... H01R 4/5008 24/134 R
3,015,509 A 1/1962 Bollmeier
3,107,966 A 10/1963 Bonhomme
3,708,611 A * 1/1973 Dinger ..... B29C 61/0616 174/84 C
4,150,251 A 4/1979 Scott
4,268,104 A * 5/1981 Kidder ..... H01R 4/2412 439/164
4,288,657 A 9/1981 Swanson
4,362,352 A * 12/1982 Hawkins ..... H01R 4/52 174/90
4,408,926 A * 10/1983 Werner ..... F16B 2/14 403/300
4,454,376 A * 6/1984 Holder ..... H01R 4/12 174/84 S
4,508,409 A * 4/1985 Cherry ..... H01R 4/2491 174/84 R
4,595,724 A * 6/1986 Koblitz ..... C08K 3/22 174/74 A
4,629,274 A * 12/1986 Pollock ..... H01R 4/2491 439/410
4,752,252 A * 6/1988 Cherry ..... H01R 4/5025 439/784
4,839,470 A * 6/1989 Ventura ..... H01R 4/20 156/49
4,924,035 A 5/1990 Marr et al.
4,944,699 A * 7/1990 Velke, Sr. ..... H01R 4/308 174/84 S
5,001,301 A 3/1991 McLaughlin et al.
5,132,494 A 7/1992 Burton et al.
5,260,515 A 11/1993 Braun
5,278,353 A 1/1994 Morton et al.
5,315,066 A 5/1994 Spiteri, Sr.
5,331,113 A 7/1994 Higgy
5,369,225 A * 11/1994 Natwig ..... H01R 4/723 174/84 R
5,378,855 A * 1/1995 Delalle ..... H01R 4/22 174/84 R
5,393,932 A * 2/1995 Young ..... H01Q 1/244 174/84 R
5,397,858 A * 3/1995 Delalle ..... H01R 4/22 174/84 R
5,418,331 A 5/1995 Delalle
5,422,438 A * 6/1995 Lamome ..... H01R 4/203 174/76
5,461,198 A * 10/1995 Delalle ..... H01R 4/12 174/84 R
5,514,836 A * 5/1996 Delalle ..... H01R 4/22 174/74 R
5,531,618 A 7/1996 Market
5,585,601 A * 12/1996 Adler ..... H01R 4/22 174/84 S
5,683,273 A * 11/1997 Garver ..... H01R 4/5025 174/84 R
5,695,369 A * 12/1997 Swenson, Sr. ..... H01H 85/201 439/428
5,868,589 A * 2/1999 Swenson, Sr. ..... H01R 13/68 337/187
5,894,110 A 4/1999 Clifton et al.
5,910,643 A 6/1999 Miskell et al.
5,922,994 A * 7/1999 Robinson, Sr. ..... H01R 4/22 174/87
5,975,939 A 11/1999 Market
6,102,709 A 8/2000 Howard et al.
6,176,051 B1 * 1/2001 Sorkin ..... E04C 5/08 403/305
6,206,736 B1 * 3/2001 DeFrance ..... H01R 4/56 439/796
6,252,170 B1 6/2001 Korinek
6,364,721 B2 * 4/2002 Stewart, III ..... H01R 11/09 174/187
6,454,598 B1 * 9/2002 Burwell ..... H01R 4/726 174/84 C
6,471,554 B2 10/2002 Armistead et al.
6,677,529 B1 * 1/2004 Endacott ..... H01R 4/187 174/84 C
6,677,530 B2 1/2004 Blaha et al.
6,796,853 B1 * 9/2004 Tomasino ..... H01R 4/5025 439/428
6,814,630 B1 * 11/2004 Tomasino ..... H01R 4/5033 439/784
6,830,491 B1 * 12/2004 Tomasino ..... H01R 4/5033 439/322
6,838,621 B2 * 1/2005 Endacott ..... H01R 4/187 174/84 C
6,953,373 B1 * 10/2005 Vos ..... H01R 4/12 174/87
7,014,513 B2 3/2006 Tomasino
7,038,136 B2 5/2006 King
7,219,399 B2 5/2007 Siegrist et al.
7,365,270 B2 4/2008 Fortin et al.
7,394,022 B2 * 7/2008 Gumley ..... H01R 4/206 174/84 C
7,420,122 B2 9/2008 King et al.
7,767,909 B2 * 8/2010 Krabs ..... H01R 4/726 174/84 C
7,786,383 B2 * 8/2010 Gumley ..... H01R 4/206 174/84 C
7,794,255 B2 9/2010 Melni
7,833,038 B1 11/2010 Hiner et al.
7,922,517 B2 4/2011 Kocher et al.
8,067,692 B2 * 11/2011 Hiner ..... H01R 4/22 174/87
8,246,370 B2 8/2012 Melni
8,348,705 B2 * 1/2013 Dickenson ..... H01R 4/12 174/87
8,350,155 B2 * 1/2013 Kobayashi ..... H01R 4/186 174/84 R
8,500,497 B1 * 8/2013 Patten ..... H01R 4/5091 439/784
8,771,000 B2 7/2014 Melni
9,017,112 B1 4/2015 Knowles et al.
9,252,504 B1 * 2/2016 Shechter ..... H01R 4/12
9,331,445 B1 5/2016 King et al.
9,450,316 B2 9/2016 Diop et al.
9,502,791 B2 * 11/2016 Diop ..... H01R 4/52
9,506,250 B2 * 11/2016 Gilling ..... E04C 5/165
9,614,304 B2 * 4/2017 Melni ..... H01R 11/28
2004/0067696 A1 * 4/2004 Vos ..... H01R 4/12 439/792
2005/0181681 A1 * 8/2005 Arai ..... H01R 4/4818 439/787
2016/0190787 A1 * 6/2016 Yamasaki ..... B32B 27/32 174/72 A

FOREIGN PATENT DOCUMENTS

GB 9203591 4/1992
GB 9526120 2/1996

* cited by examiner

IN-LINE TWIST ON ELECTRICAL WIRE CONNECTOR

BACKGROUND OF THE INVENTION

Field of the Invention

The invention relates to wire connectors, and in particular, in-line twist connectors having a truncated tapered coil.

Background

Connecting the ends of electrical wires is typically accomplished by a conventional wire nut twist on connector. As shown in FIG. 1, a wire nut connector has an open end for the insertion of the conductors of two or more wires and a truncating wire coil. When the wire nut is twisted with respect to the two or more wires, the truncated tapered coil wire coil bites into the wires as the wires are twisted about each other and retained. This is an effective connector for many situations, however when wires need to be connected and subsequently pulled through conduits, this connection is not suitable as the wire nut protrudes off to the side of the wires and creates an obstacle. In addition, the flared and open end of the wire nut connector enables the wires to be pulled out from the connector if enough force is applied and wires are moved.

In addition, many electrical connectors, such as push in electrical connectors, or other in-line twist on connectors, have limited electrical connectivity between the conductors because they rely on contact of two or more wires with a truncated tapered coil that has to be electrically conductive and have limited contact between the two wire conductors. In addition, some in-line electrical connectors have open and flared ends that provide no resistance to the wires being pulled out from the connector

SUMMARY OF THE INVENTION

The invention is directed to an in-line wire connector comprising a truncated tapered coil. The wire connector comprises two insert ends that are on opposing ends of the connector body and comprise apertures for receiving a first and a second wire. The in-line twist on wire connector of the present invention connects wires in line and may be low profile to allow the wires and the wire connector, as described herein, to slide through conduits, holes as it often required in construction and remodeling projects. The conductor body comprises at least one truncated and tapering coil that tapers toward an insert end. In an exemplary embodiment, the truncated tapering coil is conical shaped. The apertures may comprise an insulating sheath recess that is enlarged from the rest of the aperture and configured to receive the insulating sheath of a wire and thereby prevent exposure of the wire conductor. The first and second wire conductors extend past each other toward opposing insert ends to produce an overlap portion, or length of overlap of the two wire conductors to create electrical contact between wires. When the connector body is rotated, the two or more wire conductors rotate about each other and are retained by the truncated tapered coil. The enlarged twisted conductors are physically retained, dimensionally, by the truncating ends of the connector body, and/or the truncated tapered coil or coils.

The wire connector of the present invention provides good electrical contact between the connected wire conductors and therefore reduces resistance. This improved electrical contact is provided in the overlap portion of the two or more wire conductors within the cavity of the connector. In addition, the wire conductors contact the truncated tapered coil that may be made out of an electrically conductive material and further provide reduced electrical resistance. Finally, the wire conductors within the cavity may twist around each other, thereby increasing the contact area between the wire conductors and reducing electrical resistance. These three different types of contact, overlap portion, twisted conductors and contact with an electrically conductive truncated tapered coil reduce the electrical resistance between a first and a second wire conductor inserted into the opposing end of the wire connector.

The wire connector of the present invention provides improved retention between the connected wire conductors of the wire to the wire connector. In an exemplary embodiment, the wire connector has a connector body that tapers to both the first and second ends. Likewise, the cavity within the connector body may also taper to the first and second ends. Wires configured within the wire connector and twisted about each other cannot be pulled out from the wire connector due to the size restriction of the twisted wire conductors. In addition, in an exemplary embodiment, wire conductors inserted into the first and second insert end extend to the opposite end and are retained by the truncated tapered coil on either end. In this way, each of the wire conductors are retained by two separate truncated tapered coils and may also be twisted about each other to produce a very secure retention of the wires to the wire connector.

The wire connector of the present invention is easy to use, wherein the connector has to be simply twisted to retain the wire conductors to the wire connector. In one embodiment, the entire wire connector is twisted with respect to the first and/or second wires to retain them. The wire conductors within the cavity may be retained by the truncated tapered coil, wherein the truncated tapered coil bites into the wire conductors as the wire connector, or a portion thereof is twisted. In one embodiment, the wire connector comprises a first and a second connector body that may be twisted with respect to each other to retain the wire conductors within the cavity.

In an exemplary embodiment, the wire connector comprises a first and a second connector body that may be attached to form a cavity to retain the wire conductors. In this embodiment, a first truncated tapered coil configured in the cavity may taper toward the first insert end and a second truncated tapered coil may taper towards the second insert end. Each connector body may have a connector end that has an attachment feature for retaining the first and second connector bodies to each other. An exemplary attachment feature may be threads, such as male and female threads that engage to draw the first and second connector bodies to each other along a centerline. Another attachment feature may include one or more flanges that slidably engages and connects the first and second connector bodies to each other along a centerline. A slidably engaged connection may be detachably attachable by exerting enough force to pull the two connector bodies apart.

In an exemplary embodiment, a first connector body may have an insert aperture for one size wire conductor and the second connector body may have an insert aperture for receiving a different sized wire conductor or for receiving multiple wire conductors. The first and second connector bodies may be selected and attached as required for the types of wire and wire conductors to be connected. In one embodiment for example, the first connector body may receive two 20 gauge wire conductors and the second connector body may receive a single 14 gauge wire conductor. The wire conductors may overlap and upon twisting may twits around each other to produce a high level of contact for conducting electricity from the 14 gauge wire to the two 20 gauge wires. In addition, the truncated tapered coils may be made out of an electrically conductive material, such as metal, and also provide conduction from the 20 gauge wires to the 14 gauge wire, as all the wires may be in contact with the truncated tapered coil or coils.

In an exemplary embodiment, the apertures on the insert ends are configured at offsets to better allow the first and second conductors to slide past each other to create the overlap portion.

The connector bodies may comprise a translucent portion or be made out of a translucent material to enable viewing of the wire conductors within the cavity. This may allow a user to confirm that the first and second conductors are properly inserted and overlapped within the cavity before twisting to secure the wires in the wire connector. The connector bodies may be formed from any suitable plastic, or elastomer and may comprise of a material that enables the connector body to expand as the connector is twisted in order to increase the contact area between the tapered coils and the wire conductors.

The truncated tapered coils may be made of an electrically conductive material, such as a metal wire, or may be made out of a non-conductive material since the wire conductors have an overlap and/or twisted conductor portion that provides electrical contact between the two conductors. In addition, the truncated tapered coil may be a single unit that has a tapered shape and be made of a solid material, such as a solid metal insert with a tapered female thread.

In an exemplary embodiment, the overlap portion of the two conductors extends at least half the length, or more preferably at least 60% of the length, or at least 75% of the length of the wire connector, from a first to a second insert end. This substantial overlap portion, with respect to the length of the wire connector provides adequate electrical contact between the two conductors. In addition, both of the conductors may be in electrical contact with a first and/or second electrically conductive truncated tapered coil. This may further provide improved electrical contact and reduce electrical resistance through the wires.

The wire connector may have a length of about 25 mm or more, about 50 mm or more, about 75 mm or more, about 100 mm or more as measured from opposing insert ends and along a centerline through the cavity.

The apertures of the first and second insert ends may be offset along the centerline to enable and facilitate the first wire conductor end to slide past the second wire conductor end. The offset apertures may also allow for easier twisting and better retention of the conductors in the truncated tapered coils.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

FIG. 5 shows an exemplary wire connector having a first and second insert end for receiving electrical wires.

DETAILED DESCRIPTION OF THE ILLUSTRATED EMBODIMENTS

Figure 1:
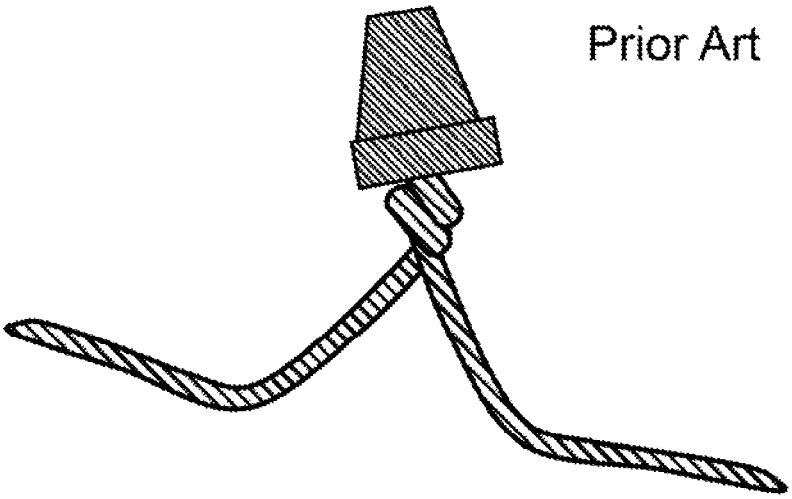
FIG. 1 shows a conventional wire nut twist on connector with two wires retained therein.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

FIG. 1 shows a conventional wire nut twist on connector with two wires retained therein.

Figure 2:
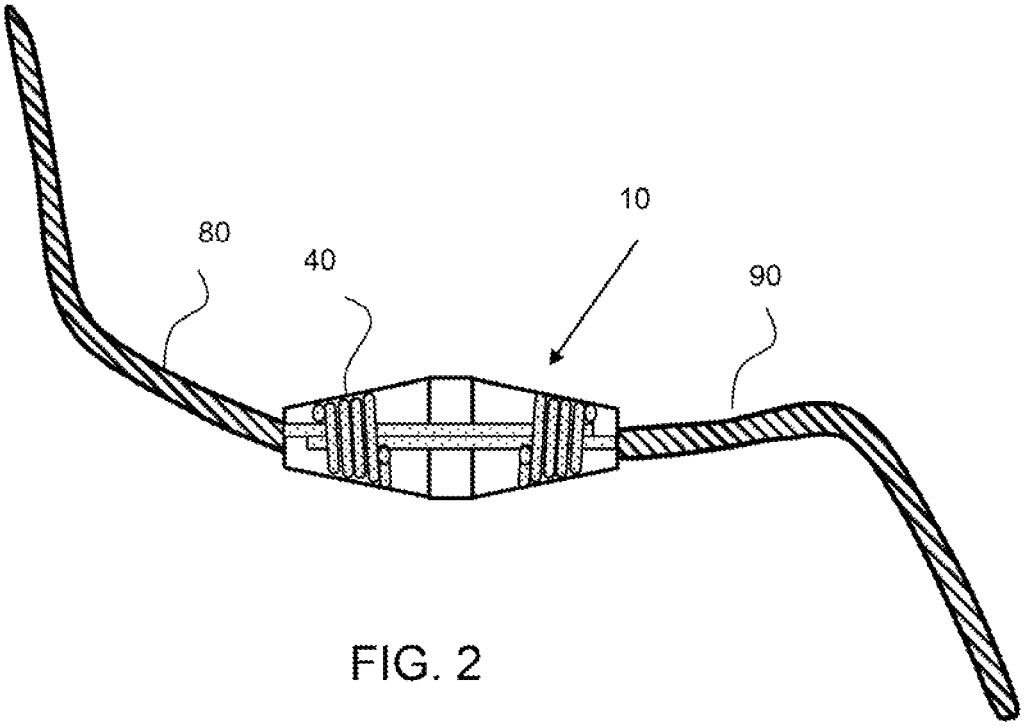
FIG. 2 shows an exemplary wire connector having a connector body that physically and electrically connects a first and second wire.

As shown in FIG. 2, an exemplary wire connector 10 has a connector body 40 that physically and electrically connects a first wire 80 and second wire 90.

Figure 3:
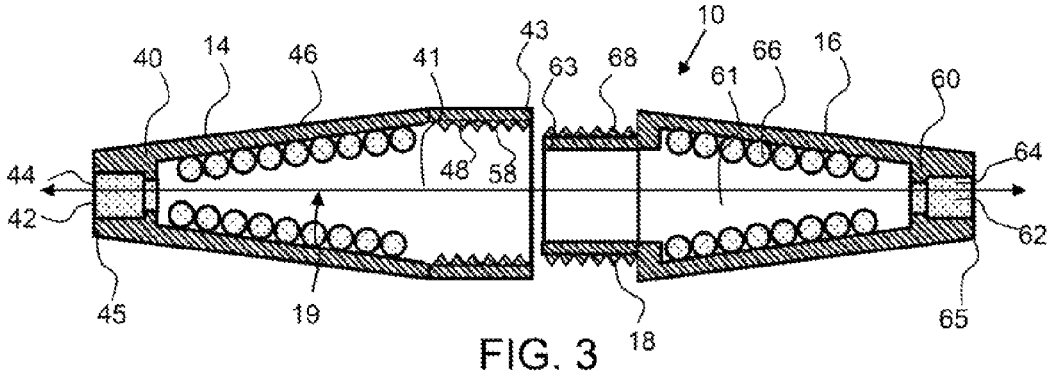
FIG. 3 shows an exemplary wire connector having a first connector and a second connector that are attachable by an attachment feature.
Figure 4:
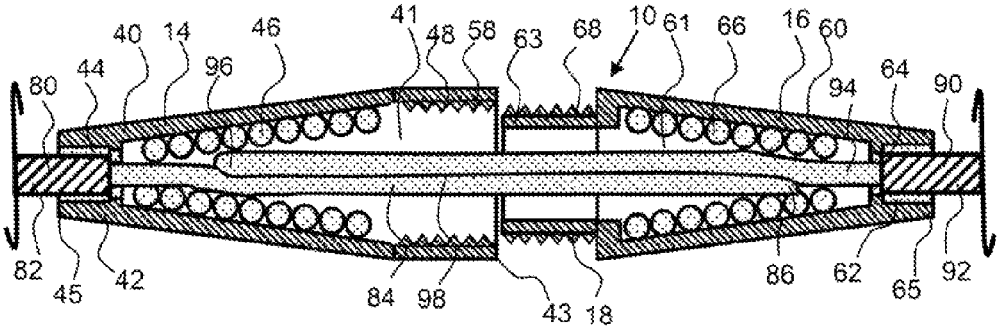
FIG. 4 shows the exemplary wire connector of FIG. 3 with a first and a second wire inserted into the connector ends of the first and second connectors and extending into the cavities.
Figure 5:
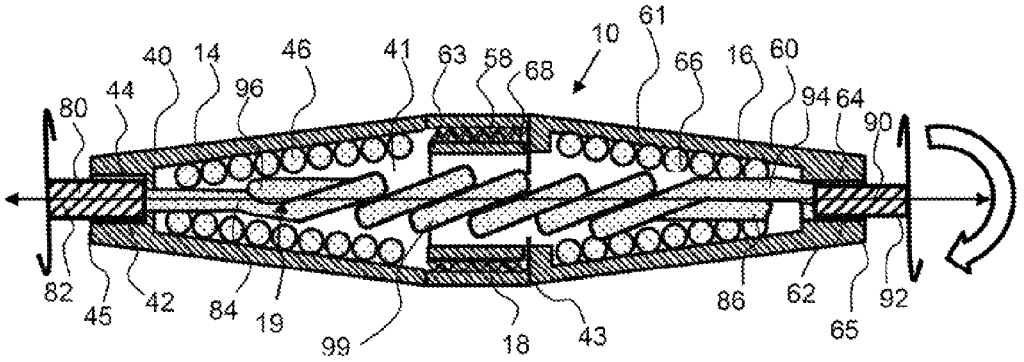
FIG. 5 shows the exemplary wire connector of FIG. 4, after rotating the first connector body with respect to the second connector body and threading the two connector bodies to each other.

Referring now to FIGS. 3 to 5, an exemplary wire connector 10 has a first connector 14 and a second connector 16 that are attachable by an attachment feature 18. The first connector body 40 has a cavity 41 and the second connector body 60 has a cavity 61 for receiving and retaining electric wire conductors. The attachment feature is a threaded connection, wherein the first connector body 40 has a female thread 58 attachment feature 18 on the first connector end 43 and the second connector body 60 has a male thread 68 attachment feature 18 on the second connector end 63. Both the first and second connectors have insert ends 45, 65 respectively for receiving a wire. The first connector end 45 has an aperture 42 with a insulating sheath recess 44 that is larger in dimension at the connector end than the rest of the aperture, thereby allowing a wire that has been stripped to be inserted and prevent the wire conductor from being exposed. Likewise, the second connector end 65 has an aperture 62 with an insulating sheath recess 64 that is larger in dimension at the connector end than the rest of the aperture. The first and second apertures may be offset from each other along a centerline 19 to allow the first wire conductor 84 and the second wire conductor 96 to more easily pass by each other when inserted. The first connector body 40 comprises a truncated tapered coil 46 with the tapered end proximal the first connector end 45 and likewise, the second connector body 60 comprises a truncated tapered coil 66 with the truncated end proximal the second connector end 65. The truncated tapered coil may be a wire coil that bites into the first and/or second wire conductors when the first connector body is rotated with respect to the second connector body. As shown, the truncated tapered coils are conical in shape. As shown, the coils have a circular cross-section wire but may have other cross-sectional shaped wires including, but not limited to, square, triangular, rectangular, or polynomial shaped wires having corners. A truncated tapered coil having a corner may provide better bite and retention of a wire conductor. A truncated tapered coil may be a wound coil, wherein the coil may move from one wrap to another wrap of the coil, or may be joined, wherein the individual coil wraps are attached to each other.

As shown in FIG. 4, a first electrical wire 80 and a second electrical wire 90 are inserted into the first and second connectors, respectively. The first wire insulating sheath 82 is retained in the first insulating sheath recess 44 and the second wire insulating sheath 92 is retained in the second insulating sheath recess 64 to prevent the exposure of bare wire. The first and second wire conductors 84, 94 extend through the aperture 42, 62, respectively, and into the first and second cavities 41, 61, respectively. The first conductor end 86 is extended into the second connector cavity 61 and the second conductor end 96 is extended into the first connector cavity 41. The first and second conductors overlap with in the connector body cavities.

As shown in FIG. 5, the second connector body 60 is twisted with respect to the first connector body 40 about the centerline 19, as indicated by the bold curved arrow. The first wire conductor 84 and the second wire conductor 94 are twisted about each other as the threads engage to draw the first and second connectors together. Twisted conductors 99 physically secure the first and second conductors together and enlarge the diameter, or cross centerline dimension, thereby preventing the first or second wires 80, 90, from being pulled from the wire connector 10. In addition, the first and second conductors are retained by the two truncated tapered coils 46 and 66, which also engages the conductors to prevent pull-out and also may provide additional electrical connectivity between the two conductors. The wire connector 10 provides improved electrical connection between the first and second conductors by having a large overlap area 98, and when the truncated tapered coil is an electrically conductive material, two other electrical connections in the truncated tapered coils. Both the first conductor 84 and the second conductor 94 may be in electrical contact with both the first truncated tapered coil 46 and with the second truncated tapered coil 66, thereby improving electrical connectivity between the two conductors and reducing resistance of electrical current flow from the first conductor to the second conductor.

Figure 6:
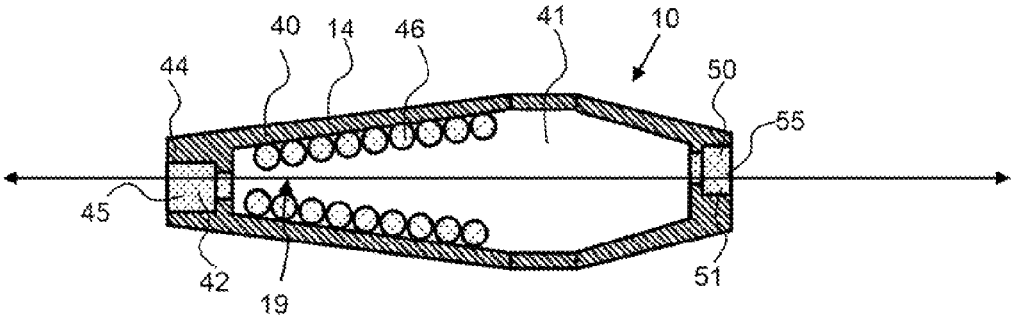
Figure 7:
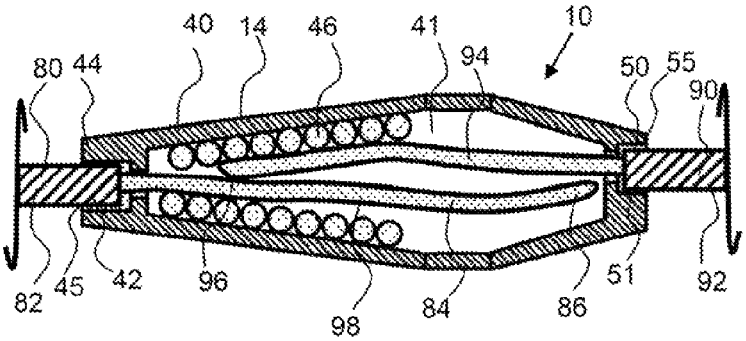
FIG. 7 shows the exemplary wire connector of FIG. 8 with a first and a second wire inserted into the insert ends.
Figure 8:
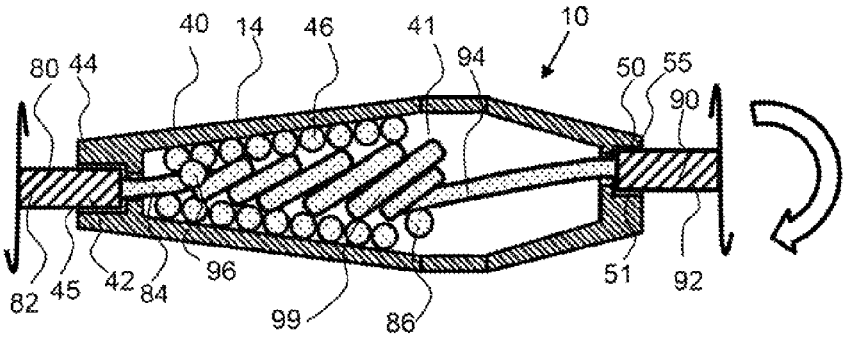
FIG. 8 shows the exemplary wire connector of FIG. 7, after rotating the connector body with respect to the electrical wires.

Referring now to FIGS. 6 to 8, an exemplary wire connector 10 has a first aperture 42 on a first insert end 45 and a second aperture 50 on a second insert end 55 for receiving electrical wires, 80, 90. The first insert end 45 has an insulating sheath recess 44 that is larger in dimension than the rest of aperture 42 for retaining the first wire insulating sheath 82, and the second insert end 55 has an insulating sheath recess 51 that is larger in dimension that the rest of the second aperture 50 for retaining the second wire insulating sheath 92. In addition, the first aperture 42 is offset to one side of a centerline 19 and the second aperture 50 is offset in an opposing direction or to an opposing side of the centerline 19. This offset configuration of the insert aperture centerlines allows the end of the first conductor 86 to pass by the end of the second conductor 96. The wire connector body 40 has a cavity 41 for receiving and retaining the first and second wire conductors 84, 94, respectively. The connector body 40 has a truncated tapered coil 46 for physical retaining the first and second conductors. The truncated tapered coil is configured proximal to the first insert end 45 and tapers toward this end.

As shown in FIG. 7, a first wire 80 is inserted into the first insert end 45, and a second wire 90 is inserted into the second insert end 55. The first wire conductor 84 extends past the second wire conductor 94 within the cavity 41 to produce an overlap portion 98. The first conductor end 86 is configured proximal the second insert end 55 and the second conductor end 96 is configured proximal the first insert end 45 and within the truncated tapered coil 46.

As shown in FIG. 8, the wire connector 14 has been rotated with respect to the wire or wires and has twisted the wires to produce twisted conductors 99 within the cavity 41 and retained by the truncated tapered coil 46. The twisted conductors are larger in dimension and therefor will not be able to be pulled out of the apertures 42, 50, thereby physically retaining the conductors in the wire connector 14.

Figure 9:
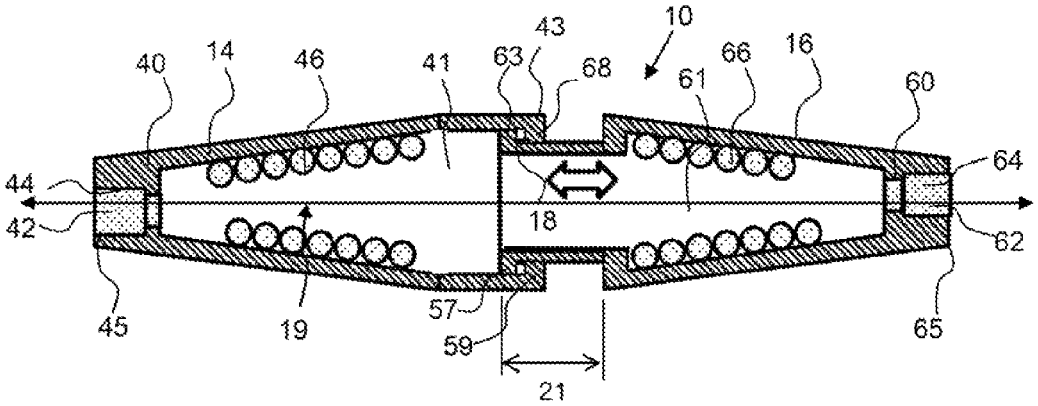
FIG. 9 shows an exemplary wire connector having a first connector and a second connector that are attached by an attachment feature having a displacement offset.
Figure 10:
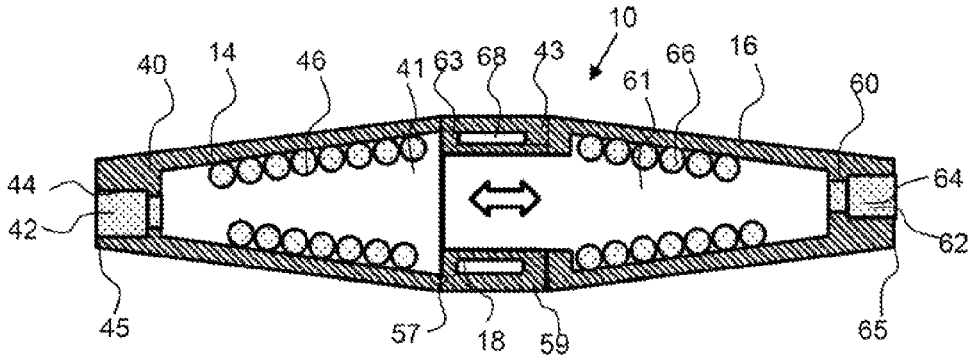
FIG. 10 shows the exemplary wire connector shown in FIG. 9 with the second connector pushed up against the first connector along the attachment feature.

Referring now to FIGS. 9 and 10, an exemplary wire connector 10 has a first connector 14 and a second connector 16 that are attachable by an attachment feature 18. The attachment feature slidably engages the first connector body 40 with the second connector body 60. The first connector body has a flange 59 that extend inward, such as radially inward, toward the centerline 19, and the second connector body has a flange 57 or enlarged portion that extends outward, such as radially outward, from the centerline 19. The two flanges create and interference fit to retain the first and second connector bodies together. The two connector bodies may be separated by pulling very hard however, to detach the first and second connector bodies from each other. This may allow for mixing and matching connector bodies for a desired wire type. In FIG. 8, the first and second connector bodies are attached by the flange type attachment feature 18, and are pulled away from each other to the displacement offset 21 distance. This displacement offset distance allows the first and second connector bodies to be drawn toward each other as the two wires are twisted about each other. As shown in FIG. 10, the first and second connector bodies are pushed against each other.

As shown in FIGS. 3 to 5, the first connector body 40 has a cavity 41 and the second connector body 60 has a cavity 61 for receiving and retaining electric wire conductors. The attachment feature is a threaded connection, wherein the first connector body 40 has a female thread 58 attachment feature 18 on the first connector end 43 and the second connector body 60 has a male thread 68 attachment feature 18 on the second connector end 63. Both the first and second connectors have insert ends 45, 65 respectively for receiving a wire. The first connector end 45 has an aperture 42 with a insulating sheath recess 44 that is larger in dimension at the connector end than the rest of the aperture, thereby allowing a wire that has been stripped to be inserted and prevent the wire conductor from being exposed. Likewise, the second connector end 65 has an aperture 62 with a insulating sheath recess 64 that is larger in dimension at the connector end than the rest of the aperture. The first and second apertures may be offset from each other along a centerline 19 to allow the first wire conductor 84 and the second wire conductor 96 to more easily pass by each other when inserted. The first connector body 40 comprises a truncated tapered coil 46 with the tapered end proximal the first connector end 45 and likewise, the second connector body 60 comprises a truncated tapered coil 66 with the tapered end proximal the second connector end 65. The truncated coil may be a wire coil that bites into the first and/or second.

Figure 11:
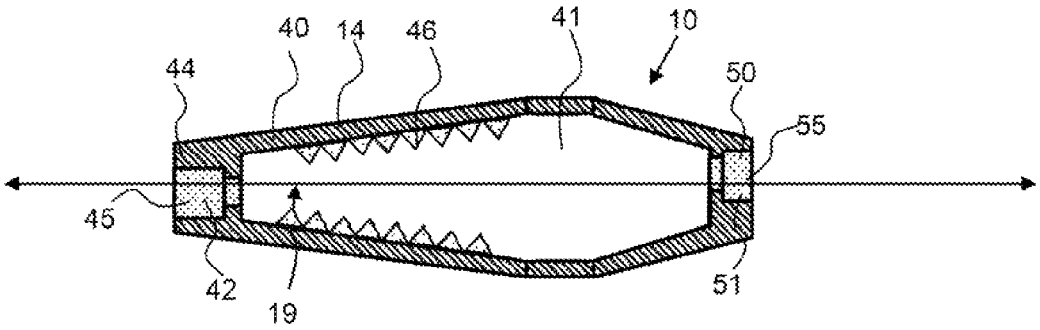
FIGS. 11 and 12 show an exemplary wire connector having a truncated tapered coil that is made of a triangular and square cross-sectional shaped wire, respectively.
Figure 12:
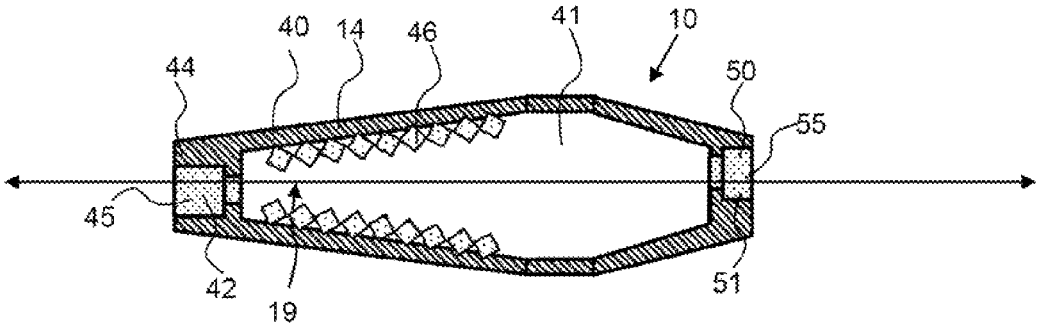

As shown in FIG. 11, an exemplary wire connector 10 has a truncated tapered coil 46 that has a triangular cross-sectional shape. As shown in FIG. 12, an exemplary wire connector 10 has a truncated tapered coil 46 that has a square cross-sectional shape. As described herein, a truncated tapered coil with corners or edges may provide for improved bite and retention of the wire conductors.

Figure 13:
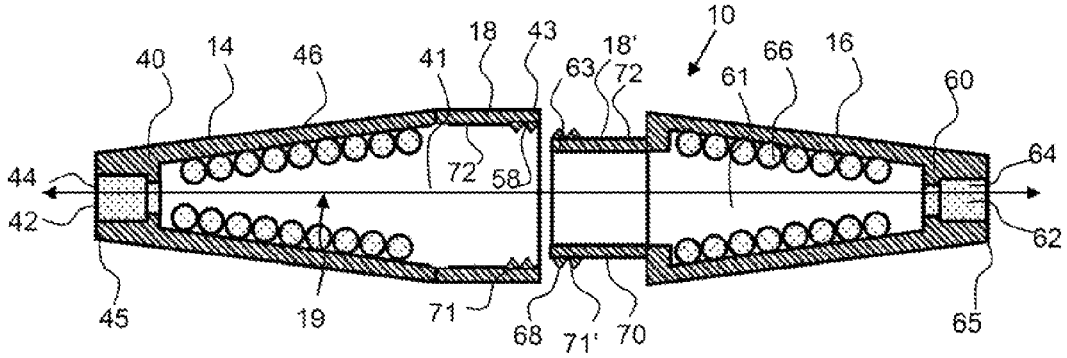
FIG. 13, shows an exemplary wire connector having a composite attachment feature comprising a threaded portion and a slidable engagement portion.
Figure 14:
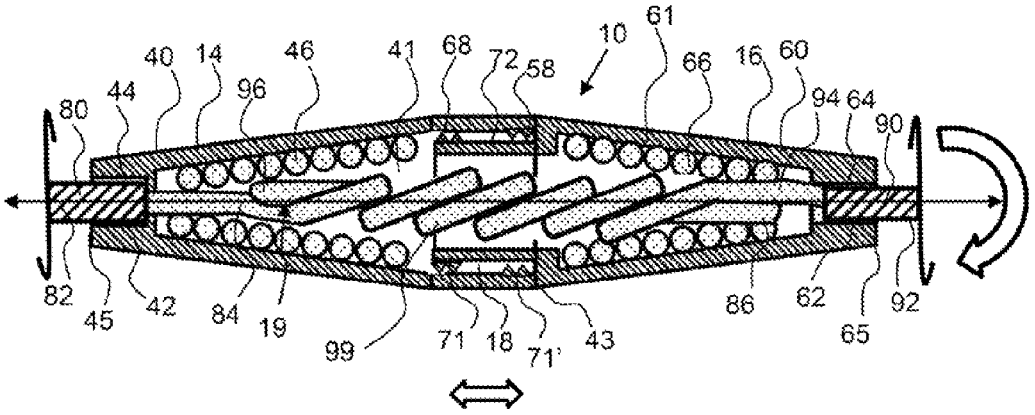
FIG. 14, shows the exemplary wire connector shown in FIG. 13, with the composite attachment feature slidably engaged to connect the first and second connector body.

Referring to FIGS. 13 and 14, an exemplary wire connector 10 has a composite attachment feature 70 comprising a threaded portion 71 and a slidable engagement portion 72. The threaded portion is on the connector ends 43, 63 of the first and second connector bodies 40, 60, respectively, and initially engages and attaches the two connector bodies. As shown in FIG. 14, the two connector bodies are slidably engaged, wherein the threaded portions 71, 71' of the two connector bodies have been threaded past each other and now the composite attachment feature is slidably engaged, wherein the first and second connector bodies can slide with respect to each other along the slidable portion. This slidable engagement enables the first and second connector bodies to slide and twist with respect to each other to enable twisting of the wire conductors within the cavity 41.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An in-line twist on wire connector comprising:

a) a first connector body comprising:

i) a first insert end having a first aperture for receiving a first wire having a first wire conductor;

ii) a first connector end having a first attachment feature;

iii) a first truncated tapered coil that tapers toward the first insert end;

b) a second connector body comprising:

i) a second insert end having a second aperture for receiving a second wire having a second wire conductor;

ii) a second connector end having a second attachment feature;

iii) a second truncated tapered coil that tap toward the second insert end;

wherein the first and second connector bodies are attached by said first and said second attachment features to form cavity for retaining said first wire conductor and said second wire conductor of the first and second wires, respectively; and wherein the first and second wire conductors extend past each other in the cavity to produce an overlap portion; and wherein the first conductor end is more proximal the second insert end and the second conductor end is more proximal to the first insert end.

2. The in-line twist on wire connector of claim 1, wherein the first and second wire conductors are twisted about each other to produce twisted conductors within the cavity and in electrical contact with the truncated tapered coil.

3. The in-line twist on wire connector of claim 1, wherein the connector body is made of an elastomer.

4. The in-line twist on wire connector of claim 1, wherein the first connector body comprises a first truncated tapered coil that tapers toward the first insert end; and wherein the second connector body comprises a second truncated tapered coil that tapers toward the second insert end.

5. The in-line twist on wire connector of claim 1, wherein the truncated tapered coils are electrically conductive.

6. The in-line twist on wire connector of claim 1, wherein the first connector body and the second connector body comprise translucent portions to allow viewing of the location of the first and second wire conductors within the cavity.

7. The in-line twist on wire connector of claim 1, wherein the first and second connector bodies are detachably attachable by the attachment feature.

8. The in-line twist on wire connector of claim 7, wherein the attachment feature comprises thread for detachably attaching the first and second connector bodies.

9. The in-line twist on wire connector of claim 1, wherein the first and second connector bodies slidably engaged by the attachment feature, wherein the first and second connector bodies have a displacement offset along a centerline extending down the cavity.

10. The in-line twist on wire connector of claim 9, wherein the attachment feature comprises a flange that prevents the second connector body from being pulled out from the first connector body.

11. The in-line twist on wire connector of claim 9, wherein the first connector body has a flange that extends outward from the centerline and wherein the second connector body has flange that extend inward toward the centerline and wherein a connector end of the second connector body extend, within the connector end of the first connector body.

12. The in-line twist on wire connector of claim 1, wherein the attachment feature comprises a threaded portion and a slidably engaging portion, and wherein the threaded portion is configured on the first and second connector ends.

* * * * *